US007014060B2

(12) United States Patent
Richardson

(10) Patent No.: US 7,014,060 B2
(45) Date of Patent: Mar. 21, 2006

(54) TWIST OPENING SEALING CONTAINER

(75) Inventor: Michael D. Richardson, Louisville, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 10/622,958

(22) Filed: Jul. 18, 2003

(65) Prior Publication Data

US 2004/0016758 A1 Jan. 29, 2004

Related U.S. Application Data

(60) Provisional application No. 60/397,194, filed on Jul. 19, 2002.

(51) Int. Cl.
*B65D 41/04* (2006.01)

(52) U.S. Cl. ..... 220/288

(58) Field of Classification Search ..... 220/288, 220/254, 314, 906, 320, 304, 269; 215/252, 215/274

See application file for complete search history.

(56) References Cited

U.S. PATENT DOCUMENTS

| | | | | |
|---|---|---|---|---|
| 2,116,199 | A | 5/1938 | Held | 29/148 |
| 2,157,896 | A | 5/1939 | Held | 220/1 |
| 2,241,846 | A | 5/1941 | Cuthbert | 215/40 |
| 2,384,810 | A | 9/1945 | Calleson | 220/1 |
| 2,409,788 | A | 10/1946 | Osborne | 226/87 |
| 2,965,256 | A | 12/1960 | Yochem | 215/43 |
| 3,032,225 | A | 5/1962 | Harding | 215/31 |
| 3,107,022 | A | 10/1963 | Wondell | 215/43 |
| 3,164,287 | A | 1/1965 | Williamson | 220/39 |
| 3,295,711 | A | 1/1967 | Abrams | 220/24.5 |
| 3,433,380 | A | 3/1969 | Kawchitch | 215/40 |
| 3,435,976 | A | 4/1969 | Owens | 215/40 |
| 3,603,472 | A | 9/1971 | Lecinski | 215/40 |
| 3,726,244 | A | 4/1973 | Arangelovich et al. | 113/7 |
| 3,727,784 | A | 4/1973 | Sargent | 215/40 |
| 3,844,443 | A | 10/1974 | Cudzik | 220/40 |
| 3,888,378 | A | 6/1975 | Gerk | 215/344 |
| 3,964,413 | A | 6/1976 | Saunders | 113/120 |
| 4,143,785 | A | 3/1979 | Ferrell | 215/270 |
| 4,173,883 | A | 11/1979 | Boik | 72/354 |
| 4,262,815 | A | 4/1981 | Klein | 220/273 |
| 4,298,129 | A | 11/1981 | Stull | 215/224 |
| 4,299,330 | A | 11/1981 | Walter | 220/288 |
| 4,322,012 | A | 3/1982 | Conti | 215/344 |
| 4,331,249 | A | 5/1982 | Banick, Sr. | 215/343 |
| 4,473,163 | A | 9/1984 | Geiger | 215/250 |
| 4,488,655 | A | 12/1984 | Itsubo et al. | 215/252 |
| 4,489,845 | A | 12/1984 | Aichinger et al. | 215/329 |
| 4,501,627 | A | 2/1985 | Althoff | 148/437 |
| 4,519,232 | A | 5/1985 | Traczyk et al. | 72/133 |
| 4,550,841 | A | 11/1985 | Sandhaus | 215/211 |
| 4,574,975 | A | 3/1986 | Taylor et al. | 220/306 |
| 4,592,476 | A | 6/1986 | Yasada | 215/252 |
| 4,693,108 | A | 9/1987 | Traczyk et al. | 72/370 |
| 4,705,183 | A | 11/1987 | Moloney | 215/276 |
| 4,732,027 | A | 3/1988 | Traczyk et al. | 72/133 |

(Continued)

FOREIGN PATENT DOCUMENTS

| | | |
|---|---|---|
| DE | 1129077 | 6/1960 |

(Continued)

*Primary Examiner*—Lien M. Ngo
(74) *Attorney, Agent, or Firm*—Sheridan Ross P.C.

(57) ABSTRACT

A resealable container is provided with a twist opening end closure which is suitable for storing perishable solids and liquids, and in one embodiment an easy open tab feature to facilitate venting.

17 Claims, 10 Drawing Sheets

U.S. PATENT DOCUMENTS

| | | | | |
|---|---|---|---|---|
| 4,774,839 | A | 10/1988 | Caleffiet et al. | 72/354 |
| 4,793,510 | A | 12/1988 | Arfert et al. | 220/306 |
| 4,813,557 | A | 3/1989 | Herron et al. | 215/329 |
| 4,813,561 | A | 3/1989 | Ochs | 215/252 |
| 4,844,270 | A | 7/1989 | Coffman | 215/274 |
| 4,880,127 | A | 11/1989 | Doi | 215/252 |
| 4,907,709 | A | 3/1990 | Abe et al. | 215/252 |
| 4,911,323 | A | 3/1990 | Arfert et al. | 220/257 |
| 5,020,683 | A | 6/1991 | Strassheimer | 215/354 |
| 5,031,787 | A | 7/1991 | Ochs | 215/276 |
| 5,100,013 | A | 3/1992 | Strassheimer | 215/354 |
| 5,103,991 | A | 4/1992 | Collins | 215/329 |
| 5,152,416 | A | 10/1992 | Cassel | 220/288 |
| 5,161,707 | A | 11/1992 | Dutt et al. | 215/344 |
| 5,293,765 | A | 3/1994 | Nussbaum-Pogacnik | 72/42 |
| 5,297,688 | A | 3/1994 | Beck et al. | 215/344 |
| 5,355,710 | A | 10/1994 | Diekhoff | 72/379 |
| 5,460,283 | A | 10/1995 | MaCartney et al. | 215/270 |
| 5,630,522 | A | 5/1997 | Montgomery | 215/344 |
| 5,718,352 | A | 2/1998 | Diekhoff et al. | 220/669 |
| 5,785,198 | A | 7/1998 | Credle, Jr. | 220/254 |
| 5,862,936 | A | 1/1999 | Johanson | 220/304 |
| 6,039,090 | A | 3/2000 | Gunn et al. | 141/12 |
| 6,065,627 | A | 5/2000 | Johanson | 220/304 |
| 6,105,807 | A | 8/2000 | McCrossen | 220/288 |
| 6,276,543 | B1 | 8/2001 | German et al. | 215/252 |

FOREIGN PATENT DOCUMENTS

| | | |
|---|---|---|
| DE | 4203238 | 8/1993 |
| EP | 0029293 | 5/1981 |
| EP | 0119055 | 9/1984 |
| GB | 2133394 | 7/1984 |
| GB | 2151591 | 7/1985 |
| JP | 401139348 | 5/1989 |

THREAD RING
AND CAN ONTO
EXPANDING MECHANISM

EXPANDING MECHANISM ACTIVATED
THREADED RING EXPANDED
BUT DOES NOT EXCEED YIELD POINT

THREAD RING PUSHED
UP ONTO CAN

TWIST OPENING SEALING CONTAINER

The present invention claims priority to U.S. Provisional Patent Application Ser. No. 60/397,194, having a filing date of Jul. 19, 2002, and is incorporated herein in its entirety by reference.

FIELD OF THE INVENTION

The present invention relates to containers, and more specifically metallic food and beverage containers, which may be selectively and repeatedly re-sealed after opening.

BACKGROUND OF THE INVENTION

Metallic food and beverage containers are well known in the art and have been made for decades to protect and store various foods, liquids, and to prevent contamination and spillage. These containers are generally one, two, or three-piece containers made of steel, aluminum, or other metal alloys and which are typically of welded, drawn and ironed ("D & I"), or drawn/redrawn ("DRD") construction. Metallic food containers generally employ seamed ends which must be opened with a can opener or other mechanical device, or have a pull tab mechanism, which cannot be resealed. Thus, subsequent to opening the entire contents must be either consumed or the leftovers transferred to a seal-able container such as Tupperware to prevent contamination and spoilage. Furthermore, food cans which require opening with a can opener may contaminate the opener with undesirable products such as pet food, etc.

Most metallic beverage containers employ a selectively opening top such as a pull-tab to provide access to the beverage contained therein. These types of mechanisms are not resealable, and thus the beverage must be entirely consumed, stored in a secondary container, or discarded.

Thus, a significant need exists for a food or beverage container which can be conveniently opened without a can opener or other mechanical opening device, and which can be repeatedly opened and closed to provide a sealed container. Furthermore, a need exists for a resealable metallic container which can withstand sterilization and the retorting of certain foods and pasteurized products contained therein.

SUMMARY OF THE INVENTION

It is thus one aspect of the present invention to provide a resealable metallic food or beverage container which can be repeatedly opened and closed. Preferably, the container and lid are sealed airtight to prevent contamination and spoilage, and more preferably the container and associated lid provide a seal at two distinct locations. Thus, in one embodiment of the present invention the lid and closure ring create two distinct locations for sealing which include an elastomeric material for sealing along the container flange, and a secondary seal between a shoulder of the attached closure ring and the container lid.

It is a further aspect of the present invention to provide a container with an easy-opening screw top lid which can be opened by children, the physically disabled, and the elderly without the need of a can opener or other tool. Thus, in one embodiment of the present invention a two-piece lid is provided which alleviates excessive sealing pressure and allows rotation of the screw lid for removal of the lid closure. Thus in one embodiment of the present invention a projecting ridge or "ledge" is provided which exerts an angular leverage on one portion of the lid closure cap by the lid closure ring, and thus facilitates easy opening by causing a gradual venting process to take place. This feature significantly reduces the vacuum opening force and hence allows the elderly or physically disabled to easily remove the sealant lid without the use of tool.

It is another aspect of the present invention to provide a resealable metallic container, which can be heated and used for foods and beverages and which must be retorted for sterilization purposes. Thus, the components of the seal-able can and lid must be made of materials which can withstand significant heat without failure, degradation or scalping into the food or beverage product.

It is a further aspect of the present invention to provide an attachment mechanism which interconnects a closure ring to a neck portion of the container and substantially prevents rotational or vertical movement of a lid closure with respect to the container body, and this maintains the integrity of the container seal. Thus, in one embodiment of the present invention a plurality of serrations are provided in the container neck portion, which substantially eliminates rotation of the closure ring on the container neck.

It is yet another aspect of the present invention to provide a metallic container body with integral metal threads, thus eliminating the need for a secondary elastomeric closure ring being positioned over the neck portion of the beverage container. Thus, in one embodiment of the present invention the threads of the container are formed from the same material as the can body.

It is a further aspect of the present invention to provide a method for applying a one-piece resilient closure ring around a neck portion of the container without damaging or otherwise compromising the integrity of the container, the closure ring or the lid closure. Thus, in one aspect of the present invention an apparatus is provided which selectively increases the internal diameter of the one-piece closure ring and slides the closure ring over a neck portion of the container. Once the closure ring is positioned around the container neck portion, the closure ring is removed from the installation apparatus and is permanently engaged around the container neck portion.

It is another aspect of the present invention to provide a resealable beverage or food container which can withstand an internal pressure of at least about 90 psi, and thus may be used for carbonated beverages. It is a further aspect of the present invention to provide a resealable container, which can withstand an internal vacuum of at least about 14 inches, and is thus suitable for use in retorting and other food container and beverage applications.

DETAILED DESCRIPTION

Figure 2:
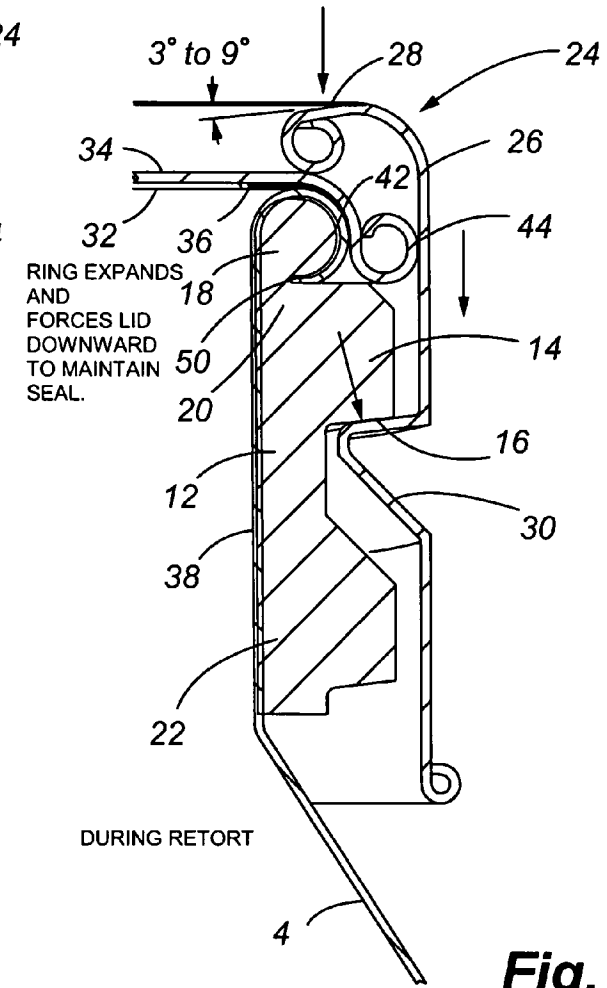
FIG. 2 is a sectional front elevation view of the embodiment shown in FIG. 1 and identifying the positioning of the lid closure and closure ring during retorting.
Figure 1:
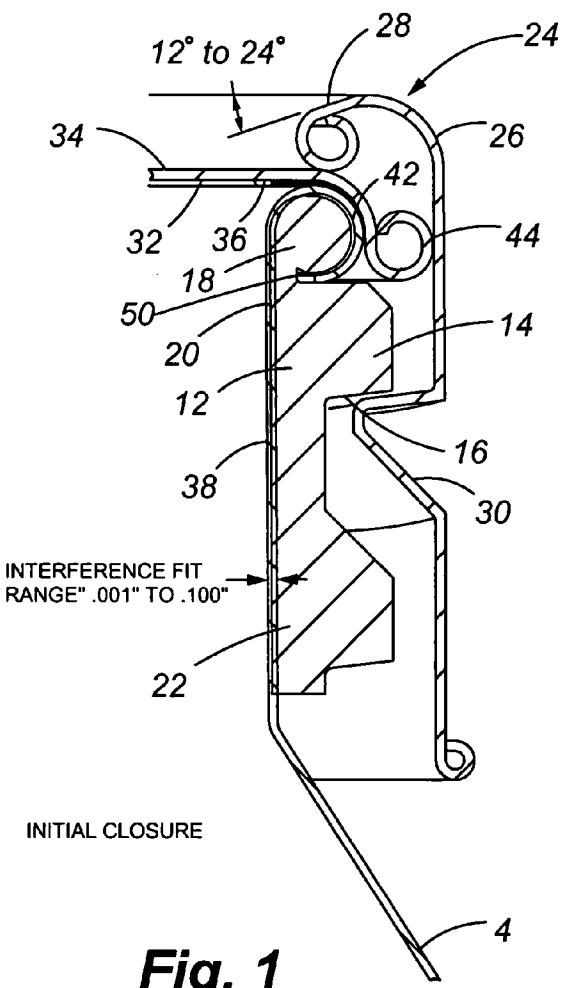
FIG. 1 is a front sectional view of one embodiment of the present invention identifying the twist opening container with the lid closure positioned on the closure ring prior to retorting.

Referring now to FIGS. 1–8, FIG. 1 and FIG. 2 are cross sectional front elevation views of one portion of the present invention showing the positioning during initial closure in FIG. 1 and subsequent positioning of the various components during retort operations in FIG. 2. More specifically, the present invention generally relates to a container body 4 such as a beverage can or food container which includes a container body neck 38, which has an upper neck flange 42, which is curled and operably interconnected to a closure ring 14. The closure ring is generally comprised of a closure ring upper end 20, a closure ring lower end 22, and a shoulder 14 positioned therebetween. The upper portion of the closure ring further comprises a closure ring bold 18 which is used for operably interconnection to the container neck flange 42 which is curled around the closure ring bulb to substantially prevent rotation or downward movement therein. The closure ring 12 further comprises a shoulder lower surface 16 which is used for creating a seal between the closure ring 12 and the lid closure 24 as discussed hereinbelow.

The lid closure 24 is generally comprised of a lid closure skirt portion 26 which has a skirt upper flange 28 and skirt closure threads 30 which are adapted for tightening and opening the lid closure 24 on the container body. As appreciated by one skilled in the art, any variation or number of threads per inch may be used for the lid closure 24. The lid closure 24 is further comprised of a cap which is positioned within the outside diameter of the lid closure skirt portion 26, and one embodiment may include a cap sealing material 36 which is positioned on a cap inner surface 32 for operable engagement with the container neck flange 42. Upon placement of the lid closure 24 on the container neck flange 42, the lid closure 24 may be tightened by generally rotating the lid closure 24 in a clockwise direction. As the lid closure 24 is drawn downward towards the container body 4, a seal is generated between a thread of the lid closure skirt portion 30 and the shoulder lower surface 16 of the closure ring 12. Additionally, and in a preferred embodiment of the present invention, a secondary seal is generated between the cap sealing material 36 positioned on the cap inner surface 32 and an uppermost portion of the container neck flange 42. The seal generated between the lid closure 24 and the container body 4 is sufficient to withstand pressures up to at least about 100 psi for carbonated beverages, or to withstand a vacuum applied during tedium and retort operations for food products and pasteurized beverages. Furthermore, in one aspect of the present invention the seal which is generated by closure from the lid closure 24 to the container body 4 is repeatable, and thus the lid closure 24 may be repeatedly opened and closed to create an airtight seal between the container body 4 and the lid closure 24.

Referring now to FIG. 2, the embodiment of the present invention shown in FIG. 1 is further depicted during retort operations when the container body 4 and lid closure 24 is subjected to heat to either sterilize food products and/or pasteurize beverages such as milk to prevent spoilage and contamination. As identified in this drawing, the downwardly pointing arrows depict the direction of travel of the lid closure 24 as heat is applied and the closure ring 14 expands downwardly due to the natural expansion of the plastic closure ring when heat is applied. This downward movement created by the expansion of the closure ring 12 further enhances the sealing contact between the shoulder lower surface 16 of the closure ring and the threaded portion of the lid closure skirt portion 26. The upper portion of the closure ring 12 is prevented from movement due to the engagement of the closure ring bold 18 with the container neck flange 42 which is curled around the closure ring bold 18 to prevent movement and/or disconnection.

Figure 3:
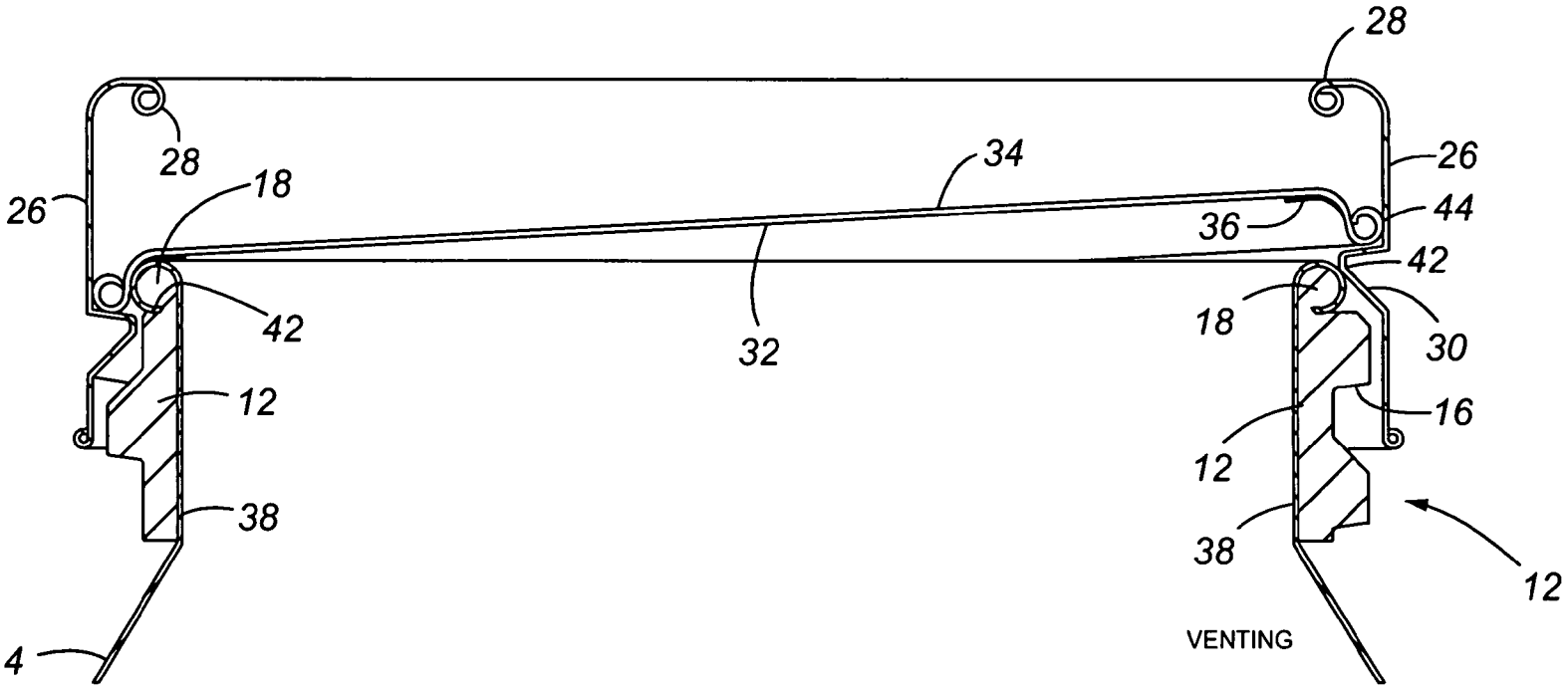
FIG. 3 is a sectional front elevation view of a container body with the associated closure ring interconnected thereto and showing the lid closure in a partially opened position.
Figure 4:
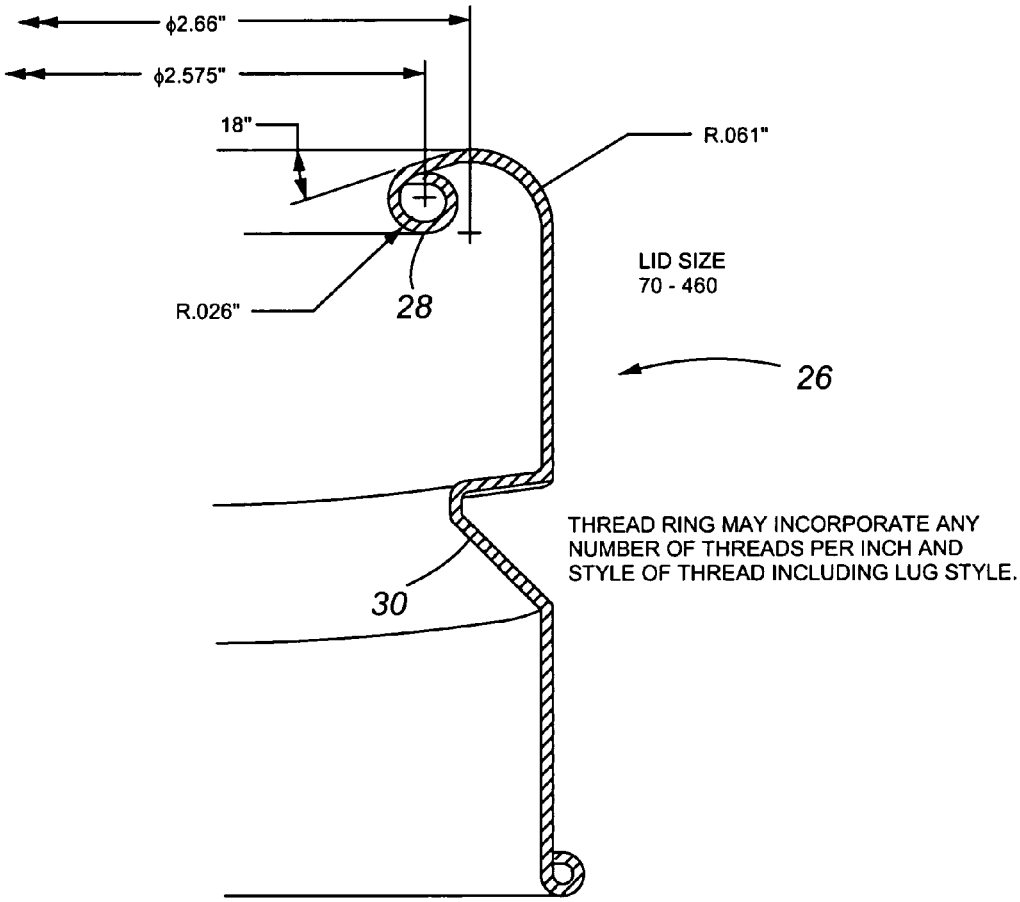
FIG. 4 is a front elevation view of one portion of a lid closure and identifying the various components therein.
Figure 6:
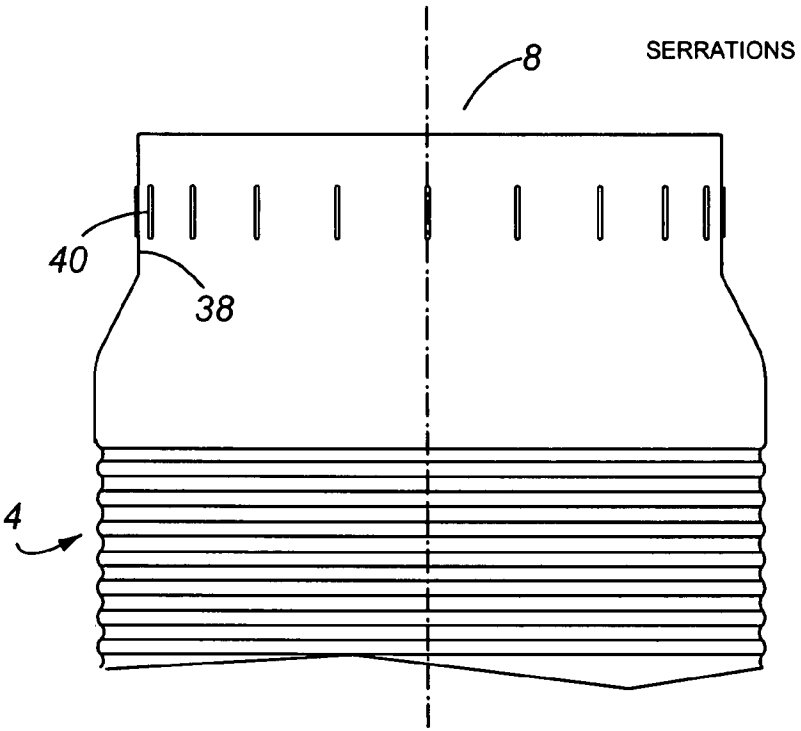
FIG. 6 is a front elevation view of the embodiment shown in FIG. 5 and further including serrations on the container neck portion to prevent movement of the closure ring.
Figure 5:
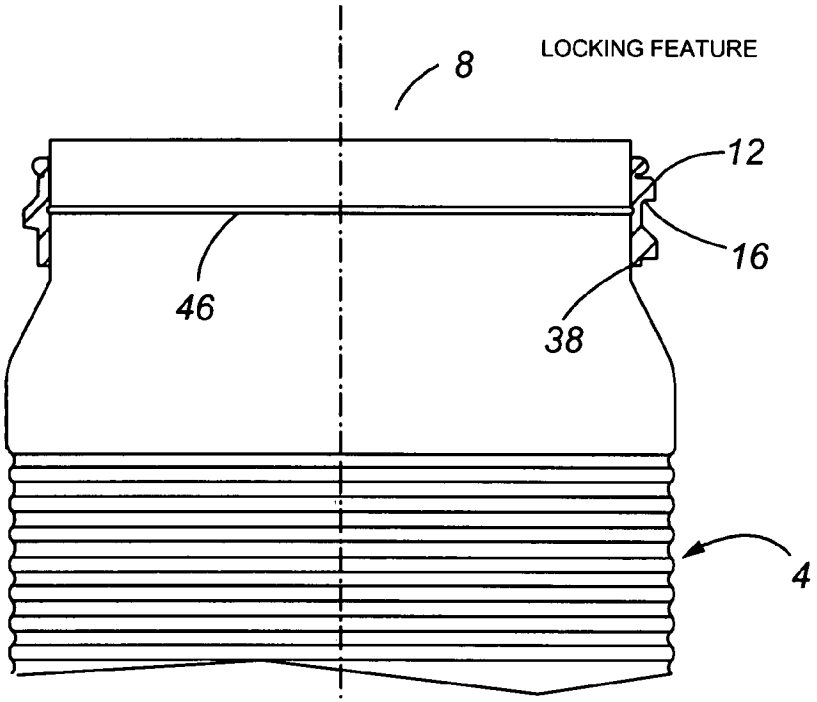
FIG. 5 is a sectional front elevation view of a container body and showing the closure ring positioned on the neck of the container body.

Referring now to FIG. 3, the lid closure 24 of the present invention is shown being selectively removed from the container body 4, which is generally achieved by rotating the lid closure 24 in a direction opposite to closure i.e. counterclockwise. In one aspect of the present invention a novel venting feature is provided which allows a seal between the lid closure 24 and the container body to be created in one distinct location as opposed to having to release the seal around the entire circumferential neck portion of the container body. As depicted in FIG. 3, the cap portion of the lid closure 24 is shown tilted with a pressure release tab 44 being pushed upwardly by a portion of the lid closure threads 30. As shown in the drawing, the opposing portion of the lid closure cap is still maintained in a lower position wherein the seal has not yet been broken. As the lid closure 24 continues to be rotated counter clockwise, the skirt closure threads 30 push upwardly on the pressure release tab 44 to break the seal created between the cap sealing material 36 and the container neck flange 42. Once the seal has been broken, the lid closure is rotated to completely disconnect the lid closure 24 from the container body 4. Referring now to FIG. 4, a sectional front elevation view of one embodiment of the present invention is shown herein wherein the lid closure skirt portion 26 is identified in greater detail. More specifically, the lid closure skirt portion 26 is comprised of a lower end, an upper end, and a skirt closure thread 30 positioned therebetween. As appreciated by one skilled in the art, the thread grain may incorporate any number of threads per inch any style of thread including the angle and orientation of the shoulder. The upper portion of the mid closure skirt portion further comprises a skirt upper flange 28 which is a curled portion which provides a downward force on a cap outer surface 34 (not shown) and which may further include the preferred embodiment, a cap sealing material 36 (not shown) to create the sealing engagement with the container body neck flange 42. Referring now to FIGS. 5 and 6, front elevation views of one embodiment of the present invention is provided herein wherein the positioning of the closure ring 12 with respect to the container body neck 38 is shown herein. More specifically, the closure ring 12 is shown positioned around the container body neck 38, to create sealing engagement. The container neck 38 may additionally include a container neck ring 46 which engages an inner portion of the closure ring 12, to prevent upward or downward movement. Further, FIG. 6 depicts an alternative embodiment of the present invention wherein container body serrations 40 are provided to engage an inner surface of the closure ring 12 to prevent movement of the closure ring 12 during opening and closing of the lid closure 24.

Figures 7, 8:
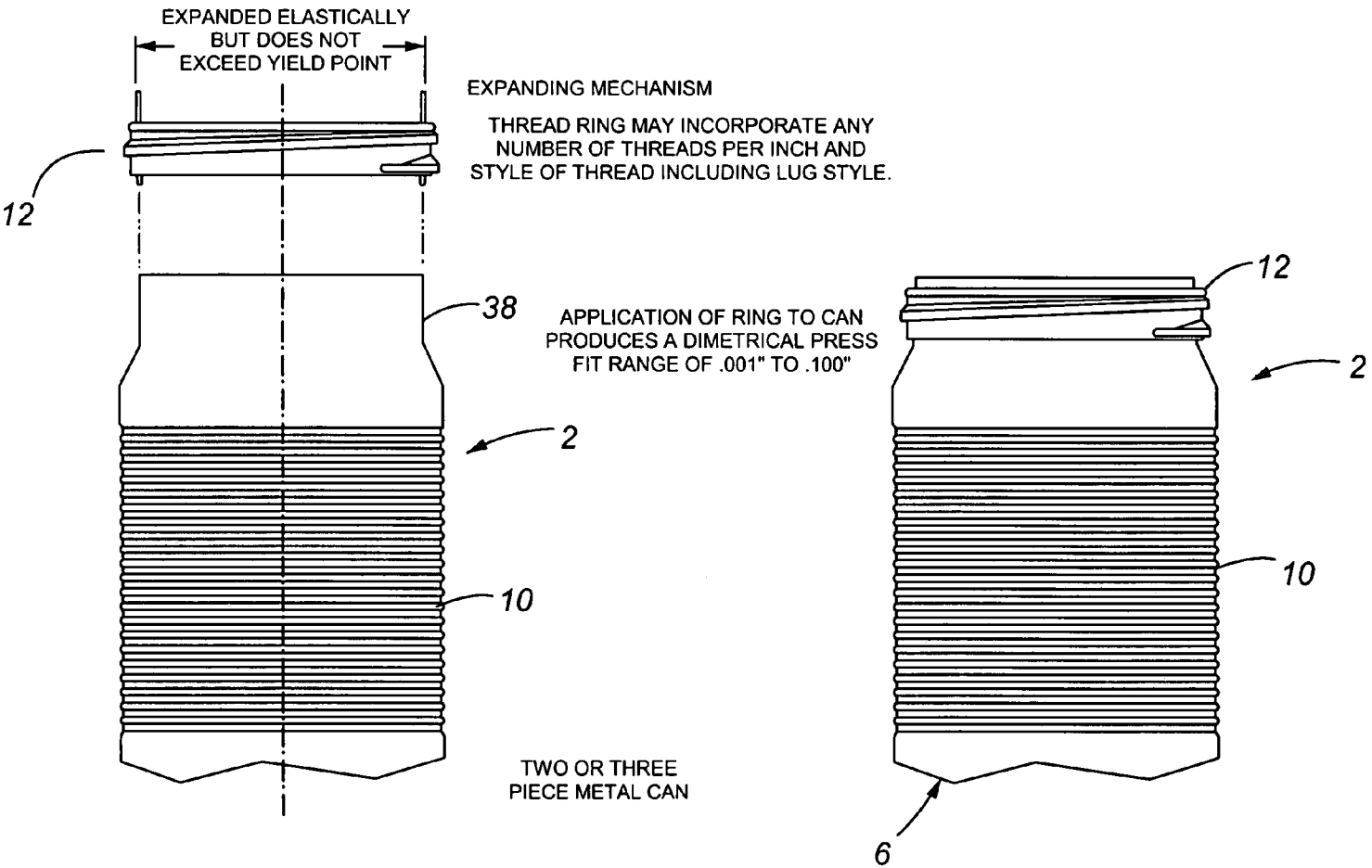
FIG. 7 is a front elevation view of a container body and showing the closure ring just prior to positioning over the neck of the container body.
FIG. 8 is a front elevation view of the embodiment shown in FIG. 7 and showing the positioning of the closure ring after placement on the neck of the container body.

Referring now to FIGS. 7 and 8, the method of providing the closure ring 12 on the container body neck 38 is shown herein. More specifically, FIG. 7 shows a portion of a tool which is used to engage the inner surface of the closure ring 12 and provide an outward force to increase the internal diameter of the closure ring 12. Once the internal diameter of the closure ring 12 is greater than the external diameter of the container body neck 38, the closure ring is lowered on to the container neck 38, and subsequently released to place the closure ring 12 in a sealing engagement with the container body neck 38 as shown in FIG. 8. This process may be continuously and repeatedly performed on hundreds of thousands of cans in a beverage/food sealing process as appreciated by one skilled in the art.

Figure 9:
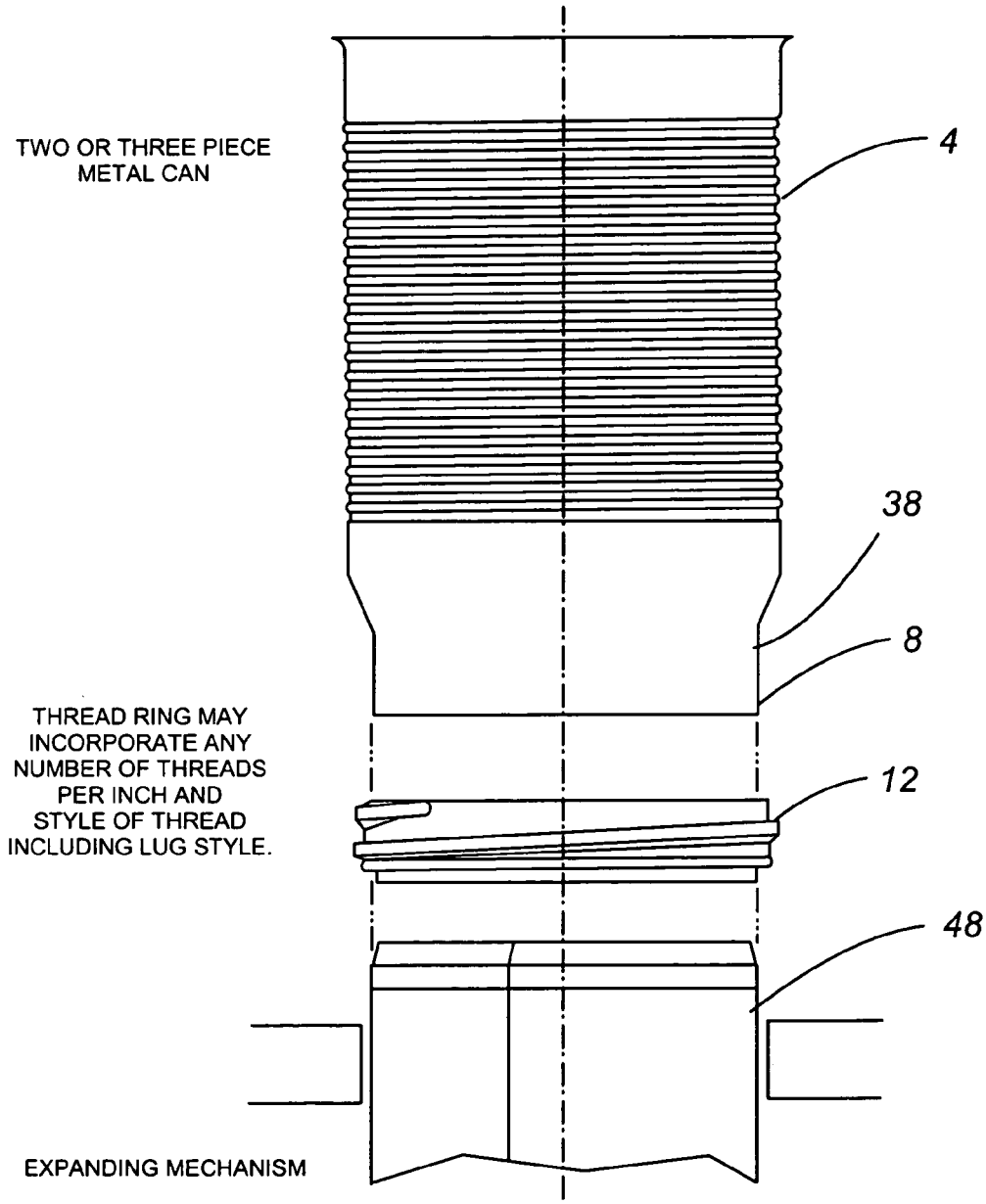
FIG. 9 is a front elevation view showing the positioning of a beverage can body, closure ring, and expanding tool prior to placing the closure ring over the neck of the beverage can body.

Referring now to FIGS. 9–13, front elevation views depicting the application of the closure ring with an expanding closure mechanism is depicted herein. More specifically, FIG. 9 shows the closure ring 12 positioned between the closure ring neck 8 and a closure ring expanding tool 48. The container body 4 is generally held in a stationary position by a mandrel or other can manufacturing device and is positioned opposite the closure ring expanding tool 48. To allow insertion of the expanding tool 48 into the closure ring 12, the exterior diameter of at least one portion of the expanding tool 48 is less than the internal diameter of the closure ring 12.

Figure 10:
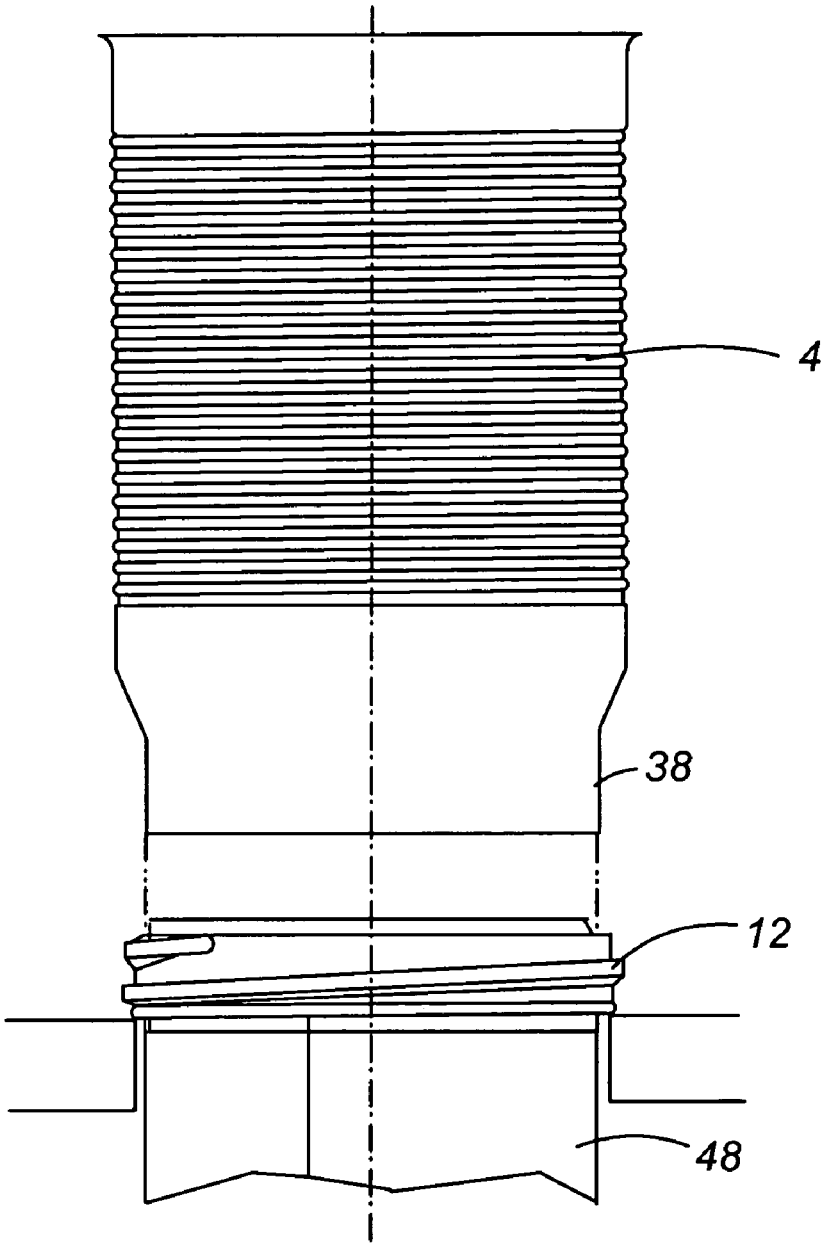
FIG. 10 is a front elevation view of the method of placement of the closure ring shown in FIG. 9 with the expanding tool positioned within the closure ring.
Figure 11:
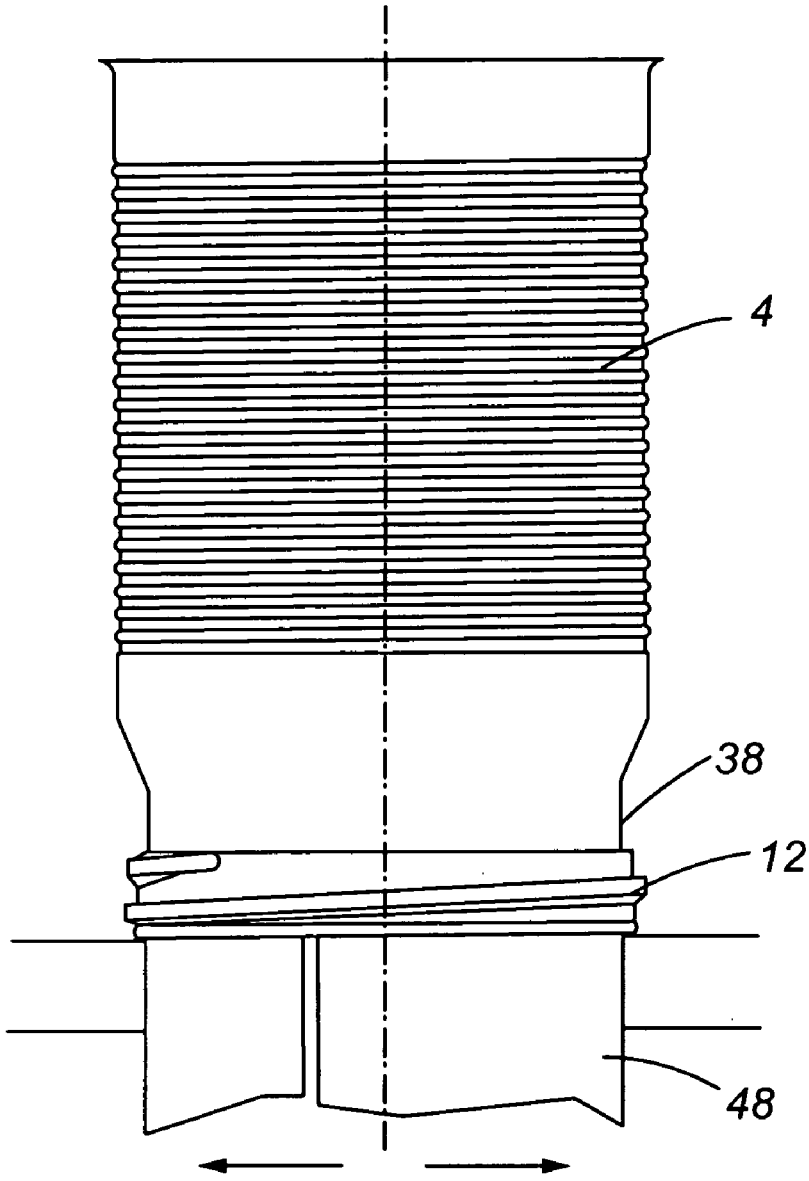
FIG. 11 is a front elevation view depicting the closure ring being applied to the neck of the container body with the expanding mechanism.
Figure 12:
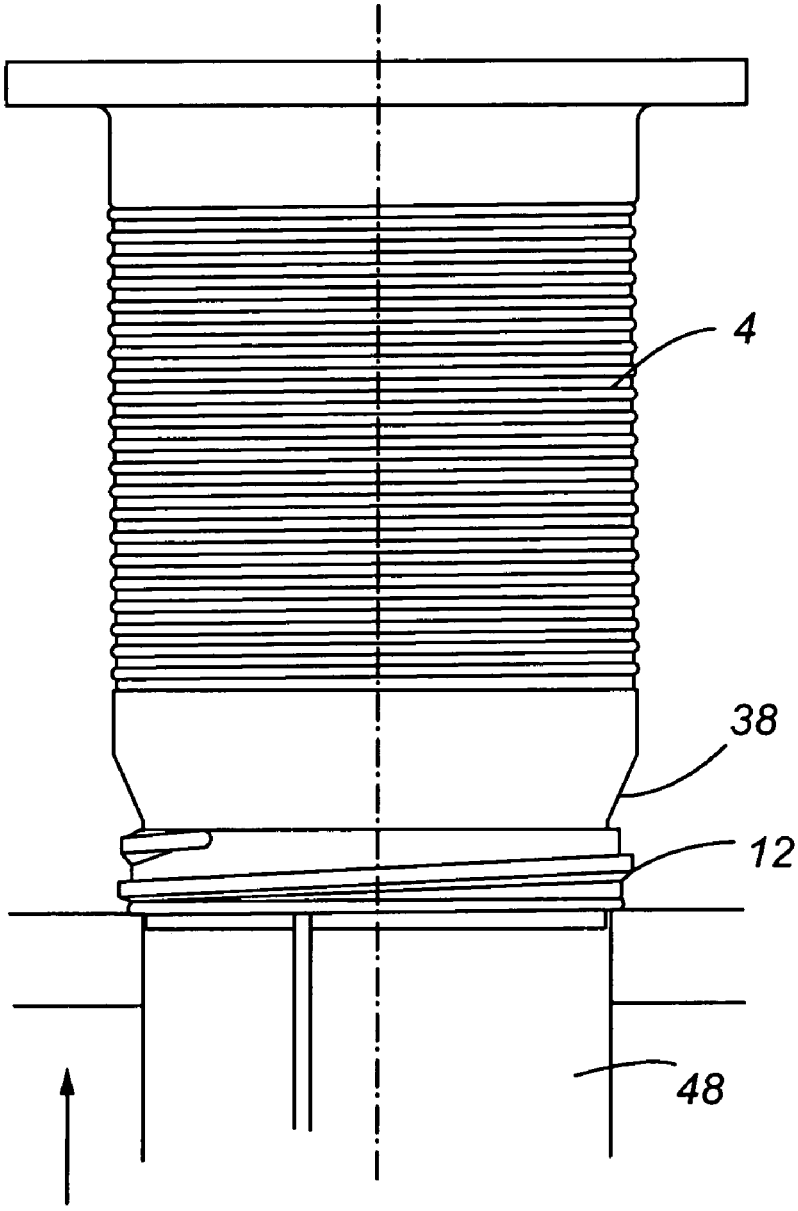
FIG. 12 is a front elevation view of the threaded closure ring positioned on the beverage can neck.
Figure 13:
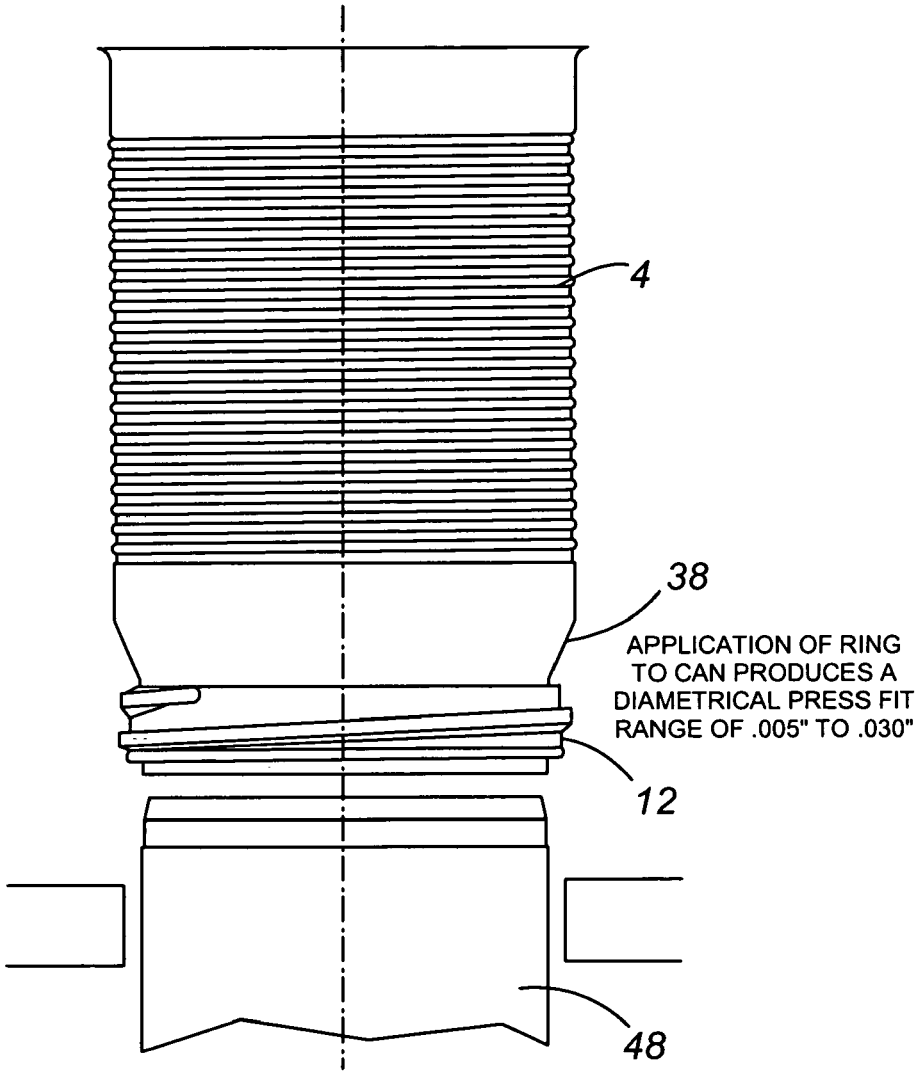
FIG. 13 is a front elevation view of the expanding tool withdrawn from the closure ring and the closure ring positioned on the neck of the container body.

Referring now to FIG. 10, the closure ring 12 is positioned over an outer diameter of the closure ring expanding tool 48 and aligned in opposing relationship to the container neck 38, and just prior to placement over the container body neck 38. Referring now to FIG. 11, the closure ring expanding tool 48 is expanded to increase the diameter of the closure ring 12 to a point where the internal diameter is greater than the external diameter of the container body neck 38. Once the closure ring diameter is increased sufficiently, the closure ring 12 is pushed onto the beverage can neck 38 as shown in FIG. 12. Subsequent to placement on the container body neck 38, the closure ring expanding tool 48 is withdrawn from the closure ring 12, which produces a diametrical press fit of the closure ring 12 on the container body neck 38 with a press fit range of between about 0.005 inches to 0.030 inches. As appreciated by one skilled in the art, this type of closure ring expanding tool may be utilized in conjunction with a can manufacturing process wherein tens of thousands of cans may be manufactured per minute with the closure ring 12 being applied to the container body neck 38 during the manufacturing process.

For clarity, the following is a list of the numbering and associated components depicted in the drawings:

| No. | Component |
|---|---|
| 2 | Twist opening container |
| 4 | Container body |
| 6 | Container body closed end |

-continued

| No. | Component |
|---|---|
| 8 | Container body open end |
| 10 | Side wall |
| 12 | Closure ring |
| 14 | Closure ring shoulder |
| 16 | Closure ring shoulder lower surface |
| 18 | Closure ring bulb |
| 20 | Closure ring upper end |
| 22 | Closure ring lower end |
| 24 | Lid closure |
| 26 | Lid closure skirt portion |
| 28 | Skirt upper flange |
| 30 | Skirt closure threads |
| 32 | Cap inner surface |
| 34 | Cap outer surface |
| 36 | Cap sealing material |
| 38 | Container body neck |
| 40 | Container body serrations |
| 42 | Container neck flange |
| 44 | Pressure release tab |
| 46 | Container neck ring |
| 48 | Closure ring expanding tool |
| 50 | Curled flange leading edge |

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. A sealable, twist opening container comprising:

a container body having a closed end, an open end and side walls extending there-between, said open end further comprising an outwardly curled flange with a leading edge oriented inwardly toward a neck of said container body;

a closure ring mounted on said neck of said container body and comprising an upper end, a lower end and engagement means positioned therebetween;

a flange engagement means positioned on an upper end of said closure ring for functionally interconnecting said outwardly curled flange to said closure ring;

a two piece lid closure comprising a skirt portion and a cap portion in operable engagement with an upper portion of said skirt portion, said skirt portion having a closure means with an upwardly oriented shoulder positioned below said cap portion for selectively interconnecting said skirt portion to said closure ring, wherein when said skirt portion is rotated in one direction said two-piece lid closure is brought to a closed and sealed condition, and said upwardly oriented shoulder is engaged with said closure ring and spaced away from said cap portion, and when said skirt portion is rotated in an opposite direction, said upwardly oriented shoulder, is disengaged from said closure ring and moves upwardly to engage said cap portion, wherein said cap portion is tilted during removal.

2. The twist opening container of claim 1, further comprising an elastomeric sealing material operably interconnected to an inner surface of said cap and positioned substantially opposite an upper end of said curled flange.

3. The twist opening container of claim 2, wherein said elastomeric material is comprised of at least one of a polyethylene, a polyvinyl, a polypropylene, an acetal and a synthetic material.

4. The twist opening container of claim 1, wherein said closure ring expands downwardly when heated, wherein a force between said closure ring and a shoulder of said skirt portion is increased.

5. The twist opening container of claim 1, wherein said flange engagement means comprises a bulb with a slot positioned therein, said slot sized to operatively receive said leading edge of said outwardly curled flange, wherein said closure ring is impeded from rotational and vertical movement.

6. The twist opening container of claim 1, wherein an upper end of said skirt portion further comprises a curled end which functionally opposes an upper end of said container curled flange to provide a flexible sealing engagement therebetween.

7. The twist opening container of claim 1, wherein said closure ring is comprised of at least one of a polyethylene, a polypropylene, a nylon, a acetal, a synthetic material and combinations therein.

8. The twist opening container of claim 1, further comprising a release tab interconnected to a perimeter edge of said cap portion, wherein when said skirt portion is rotated in said opposite direction, said release tab engages a portion of said upwardly oriented shoulder to facilitate opening of said cap portion by opening one end of said cap portion prior to an opposing end.

9. The twist opening container of claim 1, wherein said twist opening container is capable of being heated to a temperature of at least about 250° F.

10. The twist opening container of claim 1, wherein said closure ring is a metallic material integrally interconnected to a portion of said container body.

11. A sealable, twist opening metallic container adapted for storing a perishable solid or liquid, comprising:

a container body having a closed end, an open end and side walls extending there-between, said open end further comprising an outwardly curled flange with a leading edge oriented inwardly toward a neck of said container body;

a non-metallic closure ring mounted on said neck of said container body and comprising an upper end, a lower end and an engagement means positioned therebetween, said engagement means having a substantially circular geometric cross-sectional shape for operably interconnecting said outwardly curled flange to said non-metallic closure ring;

a two piece lid closure comprising a skirt portion and a cap portion operably engaged to an upper portion of said skirt portion, said skirt portion having a closure means including an upwardly oriented shoulder for selectively interconnecting said two-piece lid closure to said closure ring, wherein when said skirt portion is rotated in one direction said upwardly oriented shoulder engages said closure ring below said cap portion and said two-piece lid closure is brought to a closed and sealed condition, and said upwardly oriented shoulder is engaged with said closure ring and spaced away from said cap portion, and when said skirt portion is rotated in an opposite direction, said upwardly oriented shoulder of said skirt portion is disengaged from said enclosure ring and moves upwardly to engage said cap portion to facilitate opening, wherein said twist opening metallic container is brought to an open condition.

12. The twist opening metallic container of claim 11, further comprising an elastomeric sealing material operably interconnected to an inner surface of said cap and positioned substantially opposite an upper end of said curled flange.

13. The twist opening metallic container, of claim 12, wherein said elastomeric sealing material is comprised of at least one of a polyethylene, a polypropylene, a nylon, an acetal, a synthetic material , a foam and combinations therein.

14. The twist opening metallic container of claim 11, wherein when the perishable solid or liquid stored within said metallic container is heated to a predetermined temperature, a downward force is applied to a shoulder of said skirt portion of said two-piece lid closure.

15. The twist opening metallic container of claim 11, wherein said closure ring expands when heated.

16. The twist opening metallic container of claim 11, wherein said non-metallic closure ring is comprised of at least one foam polyethylene, a polypropylene, a nylon, an acetal, a synthetic material and combinations therein.

17. The twist opening metallic container of claim 11, further comprising a release tab functionally interconnected to a perimeter edge of said cap portion, wherein when said skirt portion is rotated in said opposite direction, said release tab engages said upwardly oriented shoulder of said skirt portion to facilitate opening of said cap portion by opening one end of said cap portion prior to an opposing end.

* * * * *